US005577287A

United States Patent [19]

Olson

[11] Patent Number: 5,577,287

[45] Date of Patent: Nov. 26, 1996

[54] LOTTERY TICKET SCRAPER

[76] Inventor: Thomas C. Olson, 11153 Saunders Ct., San Diego, Calif. 92131-1927

[21] Appl. No.: 618,038

[22] Filed: Mar. 18, 1996

[51] Int. Cl.[6] ..... B08B 11/00

[52] U.S. Cl. ..... 15/93.1; 15/93.4; 15/236.01; 30/169

[58] Field of Search ..... 15/93.1, 93.4, 15/236.01, 102, 77; 30/164.9, 169, 280, 272

[56] References Cited

U.S. PATENT DOCUMENTS

| | | | |
|---|---|---|---|
| 4,765,842 | 8/1988 | Sanders et al. | 15/77 |
| 4,793,061 | 12/1988 | Rizzo, Jr. | 15/236.01 |
| 5,253,383 | 10/1993 | Clark | 15/77 |
| 5,355,543 | 10/1994 | Cameron et al. | 15/93.1 |
| 5,402,549 | 4/1995 | Forrest | 15/77 |
| 5,419,004 | 5/1995 | Fox | 15/236.01 |

*Primary Examiner*—David Scherbel
*Assistant Examiner*—Tony G. Soohoo
*Attorney, Agent, or Firm*—John R. Duncan; Frank D. Gilliam

[57] ABSTRACT

A device for scraping an obscuring coating from a game ticket, such as a "scratcher" type lottery ticket. A housing has a slot sized to receive a lottery ticket. Inside the housing a scraper blade is positioned above the slot and a rotatable table below the slot. A ticket pushed into the slot will rotate the table away, then will pull the table back toward the slot when the ticket is pulled outwardly. The scraper blade is spring loaded against the ticket to scrape away the coating as the ticket moves out of the slot without damaging the ticket. The table is adjustable to optimize operation.

18 Claims, 2 Drawing Sheets

LOTTERY TICKET SCRAPER

BACKGROUND OF THE INVENTION

This invention relates to apparatus for scraping away a coating over numbers or other symbols on a game ticket of the sort used in many lotteries.

Many lotteries or other organizations sell or distribute card stock tickets having numbers or other symbols printed on one side, with the symbols coated with an opaque coating. The coating can be removed by scraping with a key, coin or the like to reveal the symbols. The symbols may directly indicate whether or not a prize has been won, or may be compared to publicized winning numbers.

While these tickets are convenient and protected against fraud, scraping or scratching off the coating is inconvenient and messy, often leaving shreds and crumbs of the coating material littering the areas, such as convenience stores, where the are sold. Completely removing the coating takes some time, and care must be exercised in removing only the coating and not removing or damaging the symbols.

A number of devices of varying effectiveness have been developed to aid in removing the coating. These range from simple manual scrapers in which a scraping edge is manually brought into contact with the coating while the ticket is pulled past the edge, as typically described by Rizzo in U.S. Pat. No. 4,793,061 to large, complex electrically powered devices, using a rotating brush or the like to scrape away the coating as typically described by Forrest in U.S. Pat. No. 5,402,549. With the simple device of Rizzo, the plastic scraper blade will wear rapidly and great care must be used in scraping to remove only the coating and not damage the underlying symbols. On the other hand, the Forrest device is large and expensive, must be carefully aligned to remove only the coating, and is likely to damage the symbols if the ticket should jam in contact with the rotating brush.

Other manual scrapers are described by Fox in U.S. Pat. No. 5,419,004 and Diba et al. in U.S. Pat. No. 4,777,693. These also require careful application of just the correct amount of pressure on a scraping blade assembly to fully remove the coating while avoiding damage to the symbols. There is no way of adjusting scraping pressure other than the skill of the operator. Further, as the scrapper dulls, greater pressure is likely to be applied, increasing chances of damaging the symbols, a serious consequence if the ticket is a winner. Where a guide is provided, no provision is made for adjusting the guide to compensate for wear. Also, it is often difficult to start the leading ticket edge past the scraper, resulting in buckling of the ticket edge requiring the user to resort to a coin or fingernail to remove the coating.

Other motor driven scrapers are described by Clark in U.S. Pat. No. 5,253,383 and Sanders et al. in U.S. Pat. No. 4,765,842. These also are relatively expensive, require the provision of batteries or connection to mains and require the ticket to be carefully fed past a rotating cleaning brush so as to completely remove the coating to fully remove the coating without damaging the symbols. While most scraping devices include some means for collecting the coating shreds, often these are not fully effective, allowing some of the material to remain with the ticket, resulting in littering of the area.

Thus, there is a continuing need for improved devices for removing coatings from lottery or other game tickets which fully remove the coating without risk of damaging the symbol printing, which capture and store essentially all of the removed coating material, which are compact and inexpensive, have a long-lasting scraping edge and which are easily and fully adjustable to allow easy access of the ticket into the scraper while providing the ideal scraping pressure.

SUMMARY OF THE INVENTION

It is, therefore, an object of the invention to provide a lottery ticket scraper which precisely removes an opaque concealing coating from a ticket while avoiding damage to underlying printed symbols.

Another object is to provide a lottery ticket scraper having scraping blade that is highly effective and resistant to dulling.

A further object is to provide a lottery ticket scraper which will allow easy movement of a ticket past a scraper edge in one direction while applying scraping pressure during ticket movement past the scraper edge in the opposite direction.

Yet another object is to provide a lottery ticket scraper including an adjustable table for allowing easy insertion of a ticket in one direction and providing optimum scraping pressure when the ticket is moved in the opposite direction.

Still another object is to provide a lottery ticket scraper in which alignment of the scraper edge against the ticket coating is easily and conveniently adjustable.

A still further object is to provide a lottery ticket scraper which captures essentially all shreds of scraped coating material in an easily removed and emptied container.

The above noted objects, and others, are attained by a lottery ticket scraper which basically comprises a closed housing having an elongated slot for entry of a lottery ticket, a pivotable table adjacent to the slot, spring means biasing the table towards a closed position adjacent to the slot allowing table movement slightly away from the slot by insertion of a ticket into the slot and a scraper blade having an edge spring biased into contact with the table.

At least one wall of the housing includes a removable or openable panel to allow access to internal components and for removal of accumulated shreds of coating material collected in the housing.

The position of the table relative to that of the scraper blade is adjustable to permit precise alignment with the table. While any suitable scraper may be used, glass is preferred because I have found that glass takes and retains a very sharp edge in this use.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
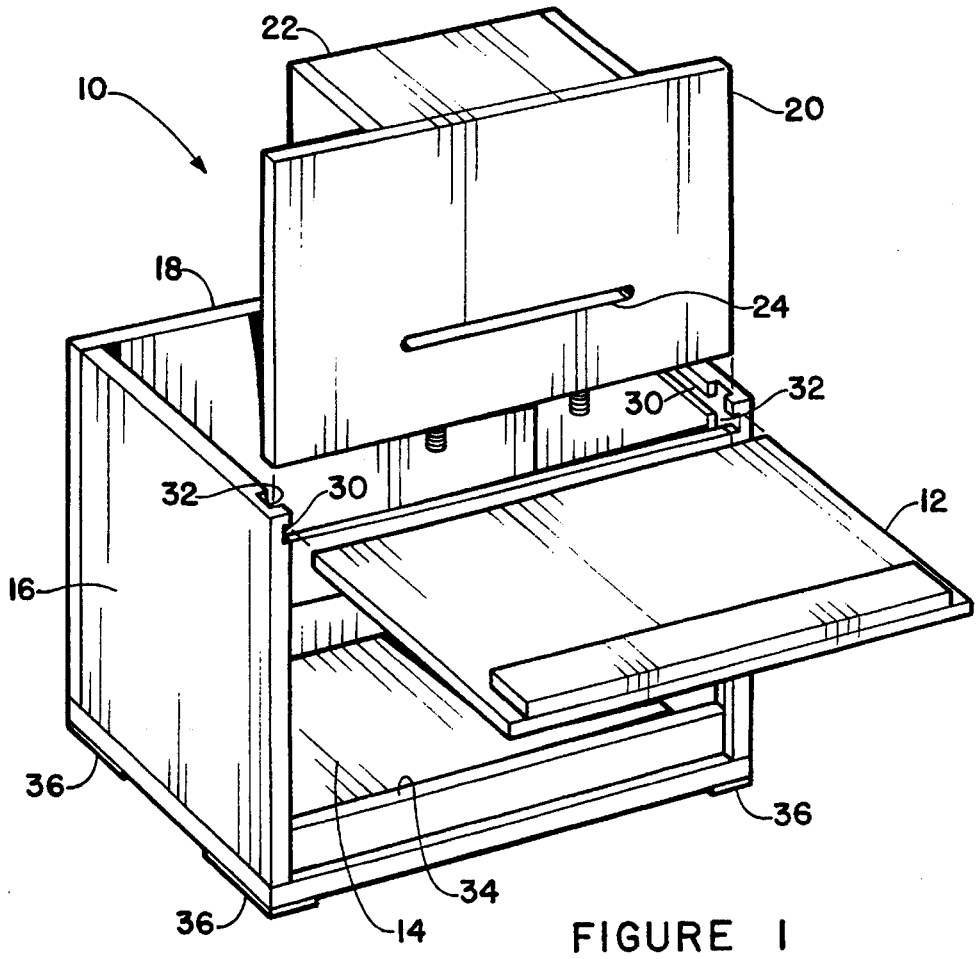
FIG. 1 is an exploded perspective view of the ticket scraping device.

Referring to FIG. 1, there is seen a housing 10 having a removable top wall 12, a bottom wall 14, two side walls 16, a back wall 18 and a removable front wall 20 that caries an enclosure 22 in which the scraping mechanism is contained.

Figure 3:
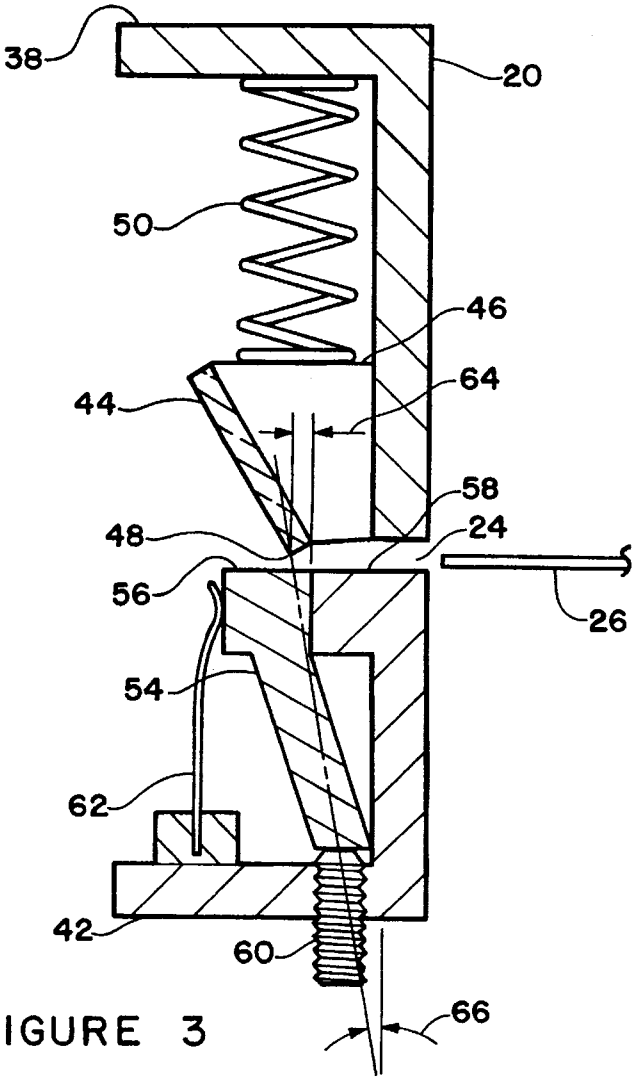
FIG. 3 is a section view taken on line 3—3 in FIG. 2.

A slot 24 defined by two elongated, closely spaced edges is provided in front wall 20 for entry of a ticket 26 (schematically indicated in FIG. 3). With front wall 20 and top wall 12 in place, housing 10 has no openings other than slot 24, so that any scraps or shreds of coating material scraped from a ticket are collected in the housing.

A strip 28 is secured to top wall 12 to aid in moving the top wall into and out of grooves 30 in side walls 16. Front wall 20 slides into and out of grooves 32 in side walls 16. A strip 34 supports the leading edge of front wall 20 at the desired position. Front wall 20 is installed, then top wall 12 is installed to close housing 10.

In order to secure housing 10 to a counter or the like, pieces of two-sided adhesive tape 36 may be provided at selected positions on bottom wall 14. Generally, tape 36 is applied with a cover sheet on the exposed surface. When housing 10 is to be secured to a surface, the cover sheets are removed and the housing and tape pieces are pressed in place.

The components making up housing 10 may be formed from any suitable material, such as metals like aluminum, wood, plastics (acrylics, polycarbonates, etc.) which may be transparent, translucent or opaque as desired, or other appropriate materials. Any desired surface coatings, indicia or instructions, advertising material, etc. may be applied to housing 10 as desired.

Figure 2:
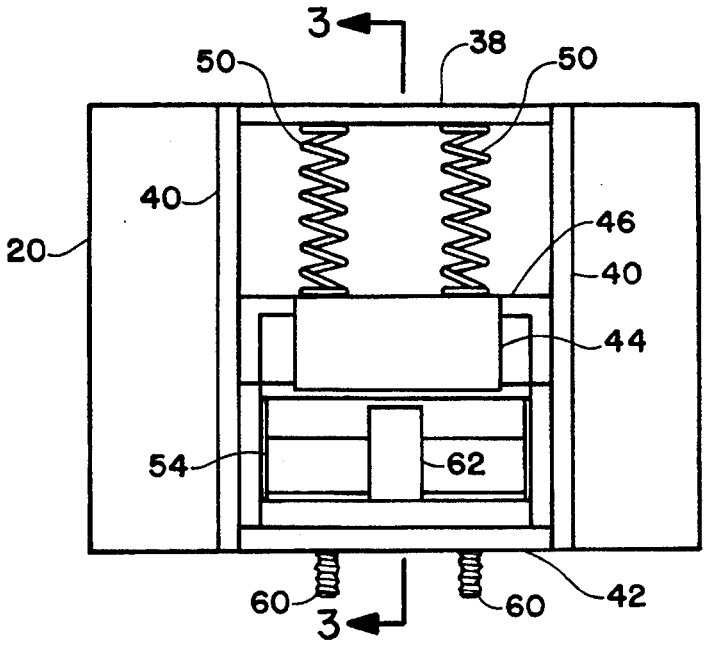
FIG. 2 is a back elevation view of the scraper mechanism, seen from the back side of the housing front wall.
Figure 4:
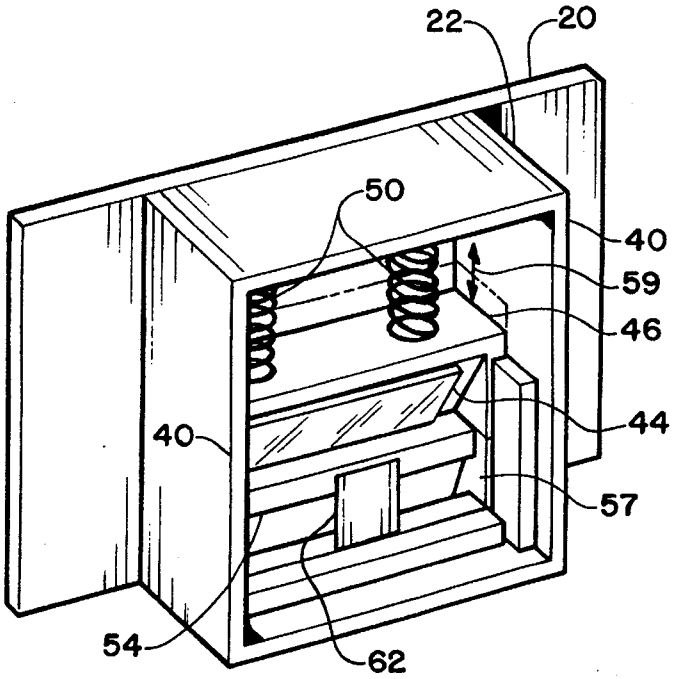
FIG. 4 is a detail view showing the blade mount stop means.

The scraping mechanism components within enclosure 22 are illustrated in FIGS. 2–4. Enclosure 22 includes a top wall 38, side walls 40 and a bottom wall 42. The enclosure is secured to the inner surface of housing front wall 20, which also forms a front wall to enclosure 22 by any suitable means, such as adhesive bonding. The back of enclosure 22 is preferably left open to provide access to the internal components.

A scraper blade 44, in this embodiment a glass sheet having flat parallel face surfaces and an end surface substantially perpendicular to the face surfaces is secured to a mount 46 vertically slidable along the inner surface of front wall 20. The scraping edge 48 is formed by the lowermost intersection of a face surface and an end surface. This edge is straight, uniform and substantially parallel to the edges of slot 24. While any suitable blade material may be used, for an optimum combination of sharpness, wear resistance, availability and low cost, glass is preferred, which may be common window glass. While metal may be used, the sharpness and wear resistance is less than that of glass. Synthetic corundum makes an excellent, very long wearing, blade edge; however, the cost of material and fabrication is quite high. While any suitable angle between blade 44 and table surface 56 may be used, for best results an angle of about 50° to 70° should be used. In most cases optimum coating removal is achieved with a blade angle of about 60°.

Compression springs bias mount 46 and blade 44 downwardly. For best results, a spring preload in the range of about 4 to 12 lb is preferred, with 6 lb generally being optimum. Small deflections in the spring have negligible effects on the preload force so the spring offers an essentially constant scraping force the card regardless of card thickness and clearance variance. In general, excellent results with clearance between blade edge 48 and table surface 56 of about 0.002 to 0.010 inch with most tickets. With conventional 0.012 in. thick tickets, the optimum setting is about 0.004 As detailed in FIG. 4, a stop 57 limits the downward position of blade 44. Stop 57 is a small piece of material secured to the interior of each sidewall 40 by adhesive bonding or the like. Blade holder 46 moves upwardly away from stop 57 during scraping, transferring the preload force to the ticket as indicated by arrow 59 and lowers into contact with the stop at rest and during ticket insertion. The optimum blade location and position are detailed below.

The lower edge of slot 24 has a horizontal entrance passage surface 58 which preferably extends a short distance into enclosure 22, along which an inserted card 26 can enter. A pivotable table 54 is positioned below slot 24, with a table surface 56 preferably substantially coplanar with, or slightly below, entrance passage surface 58. Preferably, the edge of table surface 56 adjacent to entrance passage 58 has a slight radius, typically about 0.2 inch. While the arrangement shown is most effective, if desired, entrance passage surface 58 can simply be formed by the thickness of wall 20 and the side of table 54 can have a projection corresponding to the width of the entrance passage shown. Blade edge 48 is parallel to and slightly spaced from table surface 56. Clearance between blade edge 48 and table surface 56 is preferably from about 0.002 to 0.010 inch, with 0.004 inch for 0.12 inch thick tickets being optimum. For clarity, the width of silt 24 and the space between edge 48 and table surface 56 are slightly exaggerated.

The lower edge of table member 54 rests on two adjustment screws 60, typically conventional setscrews arranged opposite table surface 56. Setscrews 60 can be adjusted to assure the entrance passage surface 58 and table surface 56 are coplanar and to assure uniform spacing of the table surface from blade edge 48. A spring 62 urges table 54 into contact with the entrance passage structure.

"Scratch off" type tickets generally have thickness in the range of from about 0.006 to 0.015 inch. For thicker or thinner tickets, the optimum trans-ticket dimensions provide in this description can be increased or decreased proportionately.

When a ticket 26 is pushed through slot 24, it would not fit between blade edge 48 and table surface 56 because they are closer together than the ticket thickness. The card pushes on table surface 56, causing table 54 to rotate or pivot away against spring 62, which provides a minimal force, preferably in the 0.2 to 1 oz range. With most conventional tickets, optimum results are achieved with a spring 62 force of about 0.5 oz.

For best results, the blade "lead-in" distance, indicated as space 64 in FIG. 3, is from about 0.03 to 0.125 inch, with about 0.063 inch generally optimum. As seen in FIG. 3, the "lead-in" distance is the distance between the tips of arrow 64. The "lead-in" distance is effectively the horizontal base of a right triangle having the end of blade 44 at edge 48 as the hypotenuse. Preferably the "pinch" angle 66, (the angle between vertical and a line drawn through the contact between table 54 and setscrew 60 and the blade edge 48) should be in the range of about 8° to 20°, with 12° generally being optimum. With a smaller pinch angle, rotation of table 54 may not open the space between blade edge 48 and table surface 56 sufficiently to allow entry of a ticket 26.

After ticket 26 is inserted until the coated area has moved past blade edge 48, the card is withdrawn to scrape away the coating. As withdrawal begins, friction between ticket 26 and table surface 56 causes table 54 to rotate back to the position shown in FIG. 3, minimally assisted by spring 62. If the pinch angle is too great, table 54 may not fully rotate back to the closed position. Since ticket 26 is thicker than the space between blade edge 48 and table surface 56, springs 50 must compress slightly to allow withdrawal of the ticket. The resulting spring force is sufficient to cause blade edge 48 to strip away a ticket coating without damaging the ticket itself. The coil springs 50 as shown are preferred since they provide a preload force. The ticket thickness is greater than the clearance between blade edge 48 and table surface 56. As table 54 rotates forward during ticket withdrawal, blade 46 is forced upward and the preload force is transferred from stops 57 to the ticket. The preload force is very low for easy withdrawal. Little force is required to remove the coating.

Thus, a ticket 26 can be easily inserted into slot 24 and past blade edge 48 and table 54, then automatically brought into pressure contact with the blade edge during ticket removal to strip off a ticket coating.

Figure 5:
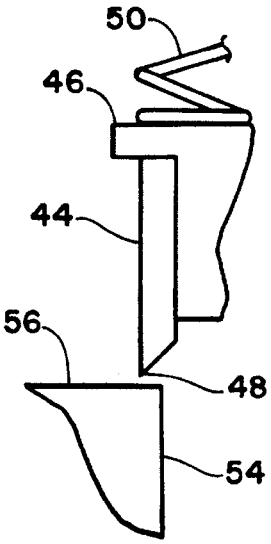
FIG. 5 is a side view of an alternative blade configuration.

An alternate embodiment of blade 44 is shown in a side elevation detail view in FIG. 5. Here blade 44 is mounted vertically in a holder 46, spring loaded by spring 50 and spaced from table surface 56 as discussed above. Instead of the entire blade being at an angle of about 60° as with the earlier blade, the blade is tapered at a 60° or similar angle. This blade has the advantage of a more compact construction.

While certain specific relationships, materials and other parameters have been detailed in the above description of preferred embodiments, those can be varied, where suitable, with similar results. For example, any suitable stop may be provided within the housing to prevent ticket insertion beyond a selected point. Other applications, variations and ramifications of the present invention will occur to those skilled in the art upon reading the present disclosure. While the scraper is preferably housed in a stand-alone unit as shown, if desired the housing may be a portion of a ticket vbending machine or other unit. Those are intended to be included within the scope of this invention as defined in the appended claims.

I claim:

1. A device for scraping a coating from a ticket which comprises:

a housing having at least a front wall;

an elongated slot defined by two closely spaced opposed slot edges in said front wall of said housing, said slot having a predetermined length for receiving an end of a coated ticket;

a table in said housing, said table having a table surface positioned generally contiguous with one of said slot edges;

a scraper blade having a scraping edge adjacent to said table;

mounting means engaging said housing for supporting said scraper blade;

blade biasing means engaging said mounting means for biasing said mounting means and scraping edge toward said table;

stop means on said housing for limiting approach of said scraping edge to said table to a predetermined distance; and means on said housing for biasing said table toward said contiguous position and for permitting a ticket entering said slot to move said table from said contiguous position.

2. The device according to claim 1 further including adjustment means on said housing for engaging said table for both adjusting said table surface position relative to said scraping edge and said one of said slot edges and for supporting said table during table movement from said contiguous position.

3. The device according to claim 1 wherein said table surface is substantially coplanar with said one of said slot edges and is substantially parallel to said scraping edge.

4. The device according to claim 1 wherein said blade biasing means comprises at least one compression spring applying a spring preload of from about 4 to 12 lb.

5. The device according to claim 1 where said blade comprises a glass sheet having two generally parallel side surfaces and an end surface, with said scraping edge formed by said end surface being oriented at approximately 90° to said side surfaces.

6. The device according to claim 5 wherein said scraper blade has a lead-in of from about 0.03 to 0.125 inch.

7. The device according to claim 1 wherein said blade comprises a glass sheet having two generally parallel side surfaces and an end surface, with said scraping edge formed by said end surface oriented at approximately 60° to one of said side surfaces.

8. The device according to claim 1 wherein said means for biasing said table comprises a cantilevered spring applying a force of from about 0.2 to 1 oz against said table.

9. The device according to claim 1 wherein said housing comprises top and bottom walls, two side walls, a back wall and said front wall, with said top wall and said front wall each removably positioned in grooves on inside surfaces of said side walls.

10. The device according to claim 1 wherein said scraper blade, scraper blade mounting means, and table are located within an enclosure secured within said housing around said elongated slot.

11. The device according to claim 1 wherein said housing comprises top and bottom walls, two side walls, a back wall and said front wall, with said top wall and said front wall each removably positioned in grooves on inside surfaces of said side walls.

12. A device for scraping a coating from a ticket which comprises:

a housing having at least a front wall;

an elongated slot defined by two closely spaced opposed slot edges in said front wall of said housing said front wall having a predetermined thickness, said slot having a predetermined length for receiving an end of a coated ticket;

an entrance passage having a surface generally coplanar with a first of said slot edges and extending a predetermined distance beyond said front wall thickness;

a table in said housing, said table having a table surface generally contiguous with said entrance passage surface;

a scraper blade having a scraping edge adjacent to said table;

mounting means within said housing for supporting said scraper blade;

blade biasing means engaging said mounting means for biasing said mounting means and scraping edge toward said table;

stop means within said housing for limiting approach of said scraping edge to said table to a predetermined distance;

means on said housing for adjusting table surface location to be coplanar with said entrance passage surface and parallel with said blade edge; and means within said housing for biasing said table toward said vestibule and for permitting a ticket entering said slot to move said table away from said vestibule.

13. The device according to claim 12 further including adjustment means engaging said table for adjusting table surface position relative to said scraping edge and said one of said slot edges and for supporting said table during table movement from said contiguous position.

14. The device according to claim 12 wherein said blade biasing means comprises at least one compression spring applying a spring preload of from about 4 to 12 lb.

15. The device according to claim 12 where said blade comprises a glass sheet having two generally parallel side surfaces and an end surface, with said scraping edge formed by said end surface oriented at approximately 90° to said side surfaces.

16. The device according to claim 15 wherein said scraper blade has a lead-in of from about 0.03 to 0.125 inch.

17. The device according to claim 12 wherein said blade comprises a glass sheet having two generally parallel side surfaces and an end surface, with said scraping edge formed by an end surface oriented at approximately 60° to one of said side surfaces.

18. The device according to claim 12 wherein said means for biasing said table comprises a cantilevered spring applying a force of from about 0.2 to 1 oz against said table.

* * * * *